United States Patent [19]

Spanel et al.

[11] 3,937,157

[45] Feb. 10, 1976

[54] METHOD AND MEANS OF TUFTING

[75] Inventors: Abram Nathaniel Spanel, Princeton, N.J.; David R. Jacobs, New Canaan, Conn.

[73] Assignee: Abram N. Spanel, Princeton, N.J.

[22] Filed: May 29, 1974

[21] Appl. No.: 474,264

[52] U.S. Cl. ..... 112/79 FF; 83/100; 83/402

[51] Int. Cl.[2] ..... D05C 15/16

[58] Field of Search ..... 112/79 R, 79 A, 79 FF, 112/79.5, 252, DIG. 1, DIG. 2, DIG. 3; 83/100, 402

[56] References Cited

UNITED STATES PATENTS

| | | | |
|---|---|---|---|
| 3,263,631 | 8/1966 | Freeman | 112/79 R |
| 3,375,797 | 4/1968 | Gaines | 112/79 R |
| 3,387,577 | 6/1968 | Spanel et al. | 112/79 FF |
| 3,595,185 | 7/1971 | Shorrock et al. | 112/79 R |
| 3,665,596 | 5/1972 | Ford | 83/402 X |
| 3,820,430 | 6/1974 | Hautemont | 83/100 |

*Primary Examiner*—H. Hampton Hunter
*Attorney, Agent, or Firm*—Steele & Petock

[57] ABSTRACT

A tufting machine having: means for metering predetermined lengths of yarn, including a rotatable yarn feed with substantially accurate improved drive and braking means; pneumatic yarn transport means, including selective control of gas flow, for transporting selected metered lengths of yarn to a tufting station for severance into yarn bits and implantations into a backing; and retraction means for retracting, with minimum yarn deformation, yarn not selected for severance and implantation.

25 Claims, 16 Drawing Figures

METHOD AND MEANS OF TUFTING

BACKGROUND OF THE INVENTION

The subject application discloses improved tufting apparatus which utilizes concepts from tufting procedures which have become known as the "Spanel Tufting System." Generally, the system utilizes pneumatic means to transport yarn to a tufting station (either in metered lengths of an unsevered yarn strand or in discrete bits), after which time the yarn is tufted, preferably by the use of multiple needles, into a backing layer to form a tufted product.

The present invention discloses improvements to the embodiments in the early Spanel patents, i.e., U.S. Pat. No. 3,554,147 which issued to Abram N. Spanel and George J. Brennan on Jan. 12, 1971 and U.S. Pat. No. Re 27,165 which issued Aug. 10, 1971 to Aabram N. Spanel and Lloyd E. Barton.

The aforementioned U.S. Pat. No. Re 27,165 discloses a pneumatic yarn transport system in which yarn strands and/or discrete bits of yarn are transported pneumatically to a tufting station where they are applied by tufting elements to a backing layer. Multicolor selection of the yarn bits is enabled by a shifting magazine arrangement, which provides yarn of various colors to each of the guide tubes through which yarn is transported to the tufting elements.

The aforementioned U.S. Pat. No. 3,554,157 describes an alternative system of U.S. Pat. No. Re 27,165 and provides for the simultaneous selection of bit-lengths of yarn of various colors for each tufting cycle at each individual tufting station. In place of the shifting magazine structure of U.S. Pat. No. Re 27,165, there is utilized a collator structure in which individual channels transport yarn into a common passageway adjacent the tufting station. The capability of severing a bit-length of yarn before, during or after threading of the tufting element and before or during actual tufting is provided. Since the severing function in the preferred embodiment takes place in close proximity to the tufting station and after a selected yarn strand has been fed into the common passageway, U.S. Pat. No. 3,554,147 discloses a pullback system to remove the yarn strand from the common passageway once a yarn bit has been severed therefrom.

In addition to the above Spanel patents, copending Spanel application Ser. No. 419,417 discloses a tufting device similar in some respects to those disclosed in the Spanel/Barton and Spanel/Brennan cases, but which utilizes a cutting arrangement employing an axially reciprocable passageway section to provide access for yarn severing means to sever the yarn into selectively sized discrete yarn bits.

In addition, copending Spanel application Ser. No. 240,119 discloses modified tufting apparatus which provides multi-color selection and utilizes a reciprocable threader tube to place yarn in the eye of a needle and retract to leave the yarn deposited therein. Pneumatic means supplement the yarn transportation system.

Finally, Spanel application Ser. No. 474,265 and Ser. No. 474,266 have been filed concurrently herewith and disclose inventions which may be used in conjunction with the subject disclosure. For example, the clamping means of Ser. No. 474,266 may be utilized with either of the principal embodiments disclosed herein and the yarn metering system of this application may be used in conjunction with the threader tube assembly of Ser. No. 474,265.

While all of the above Spanel patents and pending applications have merit and involve principles which are presently utilized, nevertheless, the subject invention provides apparatus which, for production purposes and operational efficiency, is far superior to that of the preexisting disclosures.

BRIEF SUMMARY OF THE INVENTION

In accordance with the subject invention, the Spanel apparatus disclosed herein utilizes a yarn feeding and metering system which comprises a yarn feed wheel and a corresponding drive roll positioned to, upon actuation, transfer rotary motion from the drive roll to the feed wheel to meter a selected yarn length to be pneumatically transported to the tufting station. Energization of a control element, or selection actuator, which may be a solenoid, pneumatic drive, or the like, trips or actuates an intermediate mechanism which concurrently removes a brake from the feed wheel and initiates transfer of rotary motion from the drive roll to the feed wheel.

This intermediate mechanism also contains a component which actuates a yarn pullback and release device, functionally resembling that of the aforementioned Spanel U.S. Pat. No. 3,554,147. During pullback the yarn strand is retracted from the common passageway, and with release is released back into the common passageway, at which time the pneumatic yarn transport also is actuated to transport the selected yarn strand to the tufting station.

In one embodiment, valvable pneumatic flow means is disclosed which is actuated by the intermediate mechanism. Thus, portions of the pneumatic transport operate only when the yarn is actually being transported, representing substantial savings in operational costs.

Also disclosed is a large-radius type of yarn retraction (pullback) mechanism which produces less yarn deformation than the mechanisms disclosed in earlier patents.

When the yarn reaches the tufting station, a shuttle nose block reciprocates to permit yarn severing means access to the common passageway and to engage an anvil positioned below, thus severing the yarn strand into a discrete bit-length of yarn for tufting.

DETAILED DESCRIPTION

As shown in the succeeding FIGURES, five yarn strands, each representing a different color or some other variable, are available for each tufting station, although this number is not to be construed as limiting.

Figure 1:
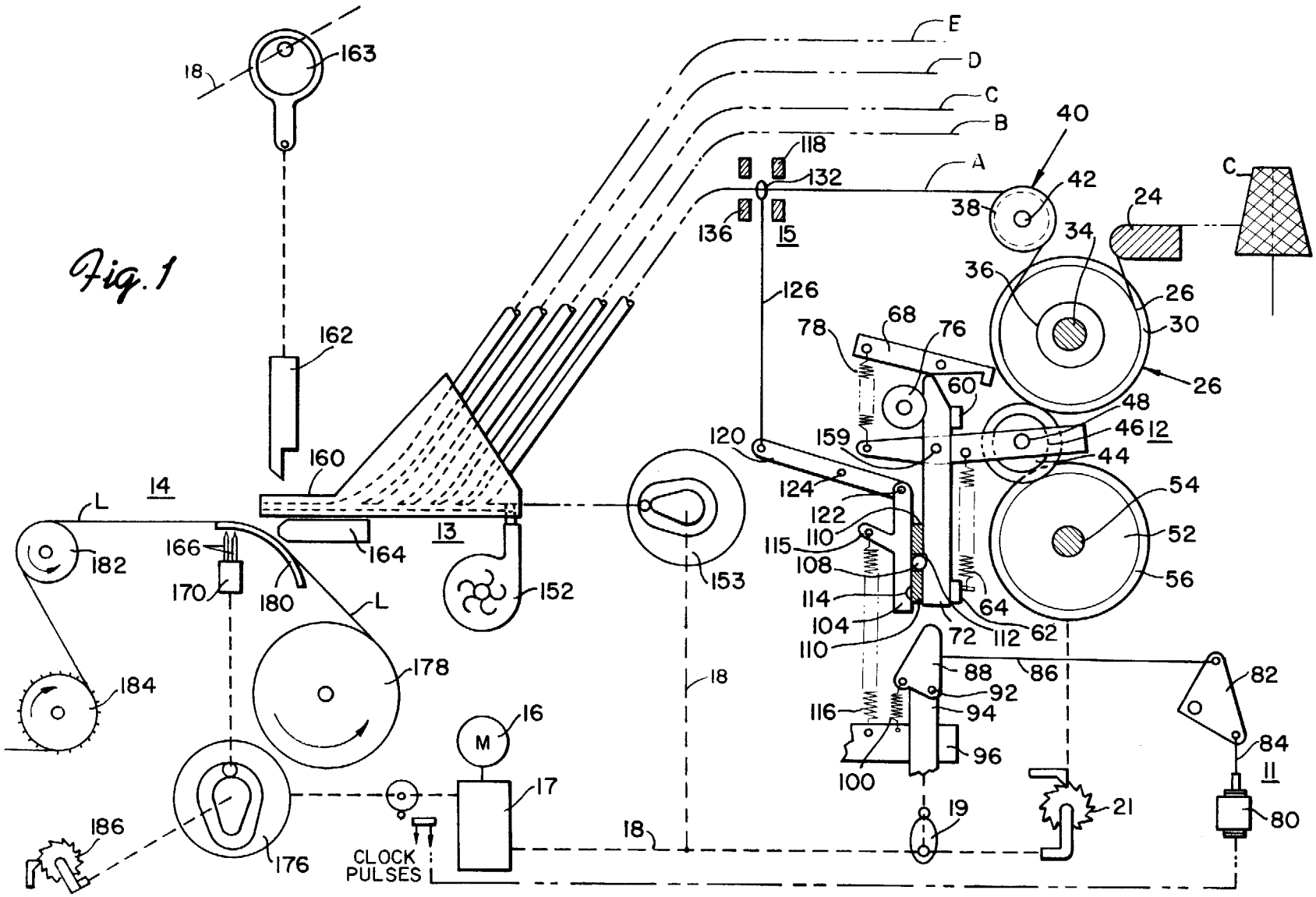
FIG. 1 discloses a schematic view of a first embodiment of the tufting apparatus.

As seen in FIG. 1, the tufting machine includes selection actuation means 11, yarn metering and feeding apparatus 12, pneumatic transport apparatus 13, a tufting station 14, and yarn pullback apparatus 15. Control signals for operation of each selection actuation means 11 may be provided by any of various readout devices. To reproduce a desired pattern on the backing layer, pattern information recorded on tapes, drums or other medium is converted into electrical or other type of signals which, at the proper time with regard to the machine tufting cycle, as indicated by the dashed clock pulses of FIG. 1, are transmitted to the selection actuation means 11. The selection actuator may be the solenoid 80 shown in various figures or it may be any suitable one of a variety of electrical, thermal, pneumatic, hydraulic, etc. type actuators.

A motor 16 is shown driving the machine by means of transmission 17 which may be a train of gears or comprise other mechanisms. A shaft 18 is schematically shown running throughout the device from which operate drive mechanisms which will be described subsequently.

Briefly, specific color selection signals are generated in response to the color requirements of a desired pattern, and for each of the color selection signals transmitted to a selection actuation means 11, a predetermined length of the selected yarn is metered by the metering and feeding apparatus 12 and advanced with the assistance of the pneumatic transport apparatus 13 so that the selected yarn strand extends into a common passageway to the tufting station 14 where it is cut and the resultant yarn bit is tufted into backing layer L. The pullback apparatus 15 will remove the last-selected yarn stand from the common passageway adjacent the tufting station after the cutting, preparatory to the next yarn color selection by the control signals.

In detail, and with reference to FIG. 2, the creel tubes 20A–E extend from the position of the creels to where they are secured to header plate 22, below which the yarn strands A–E go through one of the five metering and feeding complexes 12, one of which will now be described in detail.

As the yarn strand approaches its respective metering station 12, it is engaged by a cross-over yarn guide 24 which aligns it with a yarn feed wheel 26.

The feed wheel 26 has a side mounted trough-like yarn groove 28 and a peripheral drive groove 30, the purpose of the latter to be described subsequently. The feed wheel 26 is rotatably mounted by means of a ball bearing 36, or other suitable bearing, on a stationary mounting shaft 34 which runs widthwise (approximately parallel to needle bar) of the machine. The yarn strand is carried around the yarn feed wheel 26 through yarn groove 28 which has a friction surface to a point where it is received by yarn groove 38 of the yarn guide wheel 40, which is rotatably mounted on shaft 42. As the yarn strand leaves guide wheel 40, it travels through pullback apparatus 15, and is then directed toward pneumatic transport apparatus 13.

The yarn feed wheel 26 is driven by rotary motion which is transmitted through an engaging wheel 44 by means of a tapered outer surface 46 which meshes with drive groove 30 of the yarn feed wheel 26. The engaging wheel 44 is rotatably mounted on axle 48, which is supported by the structure of a carrier 50.

A drive roll 52 is positioned on the opposite side of the engaging wheel 44 from the feed wheel 26. The drive roll 52 is mounted on drive shaft 54 and has a drive groove 56 which is at all times in engagement with the tapered outer surface 46 of engaging wheel 44. This is in contrast to the relationship between the engaging wheel 44 and the feed wheel 26, the latter of which is only engaged by the former when the carrier 50 is shifted as will be described subsequently. The drive shaft 54 is intermittently rotated a desired angle by drive roll ratchet 21 (see FIG. 1).

Figure 2:
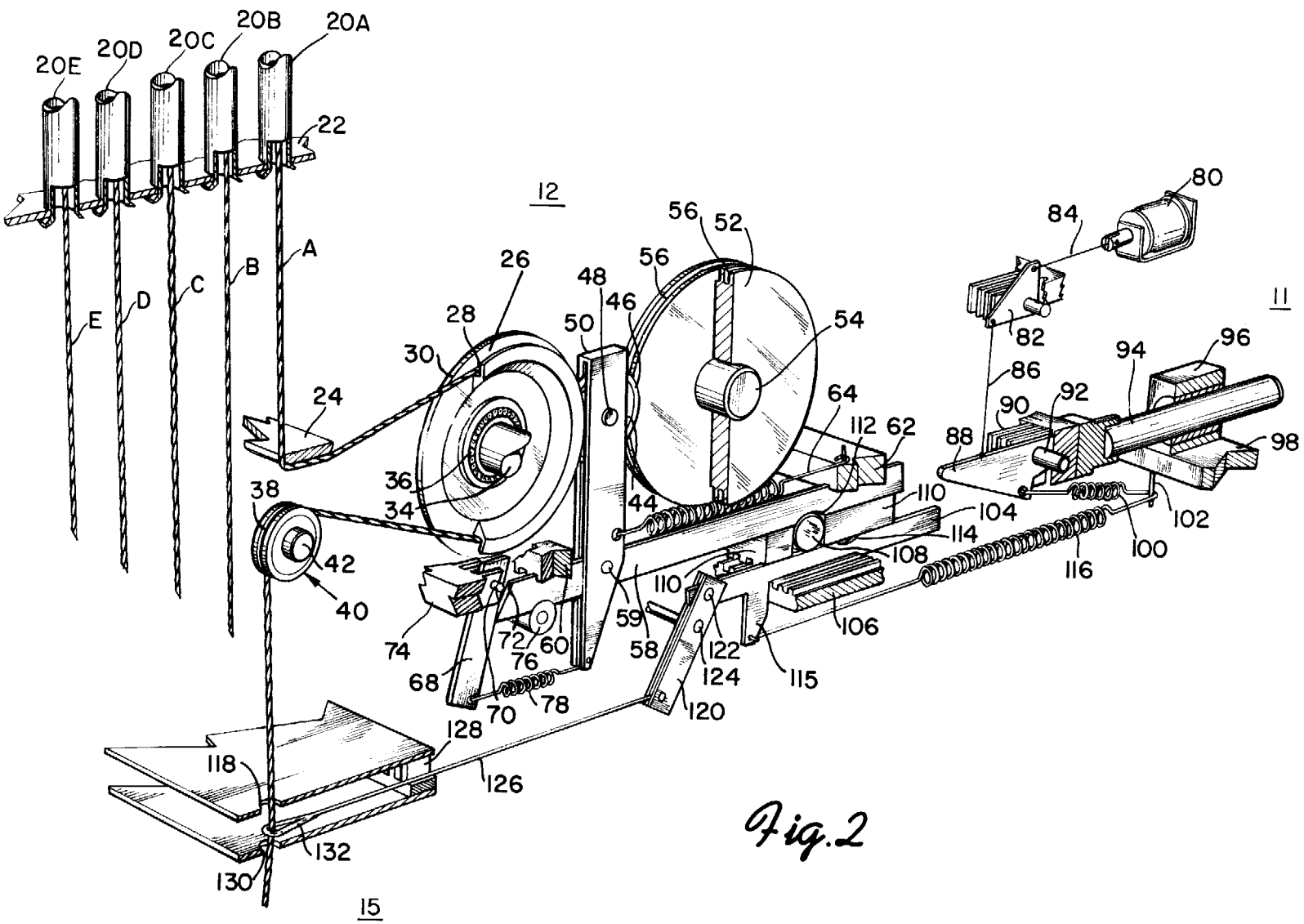
FIG. 2 is a perspective view of the yarn metering, feeding and pullback mechanisms of the first embodiment of the tufting apparatus.

In FIG. 2, below the feed wheel 26, engaging wheel 44 and drive roll 52, is a selector bar 58 to which the engaging wheel carrier 50 is pivotally connected by pivot pin 59. Positioned to the left of carrier 50 is a first bearing guide 60 for the selector bar 58 and to the right of drive roll 52 is a second bearing guide 62, both of which comprise bar-like members which run widthwise of the machine and have downward facing comb-like grooves to receive each succeeding selector bar 58 along that tier of the machine. A selector bar return spring 64 extends from the carrier 50 to the bearing guide 62 and biases carrier 50 and selector bar 58 to the right. At the base of feed wheel 26 is a brake tab 68 which upon engagement with groove 30 of feed wheel 26 will restrain the feed wheel until brake tab 68 is disengaged. A pivot pin 70 extends through the brake tab 68 and pivotally secures the tab within a comb-like recess of carrier bar 74, which extends widthwise of the machine. A relatively frictionless bearing wheel 76 is located at the base of selector bar 58 and serves to slidably support the left end of the selector bar. Tension spring 78 links the brake tab 68 to the carrier 50.

Figure 6:
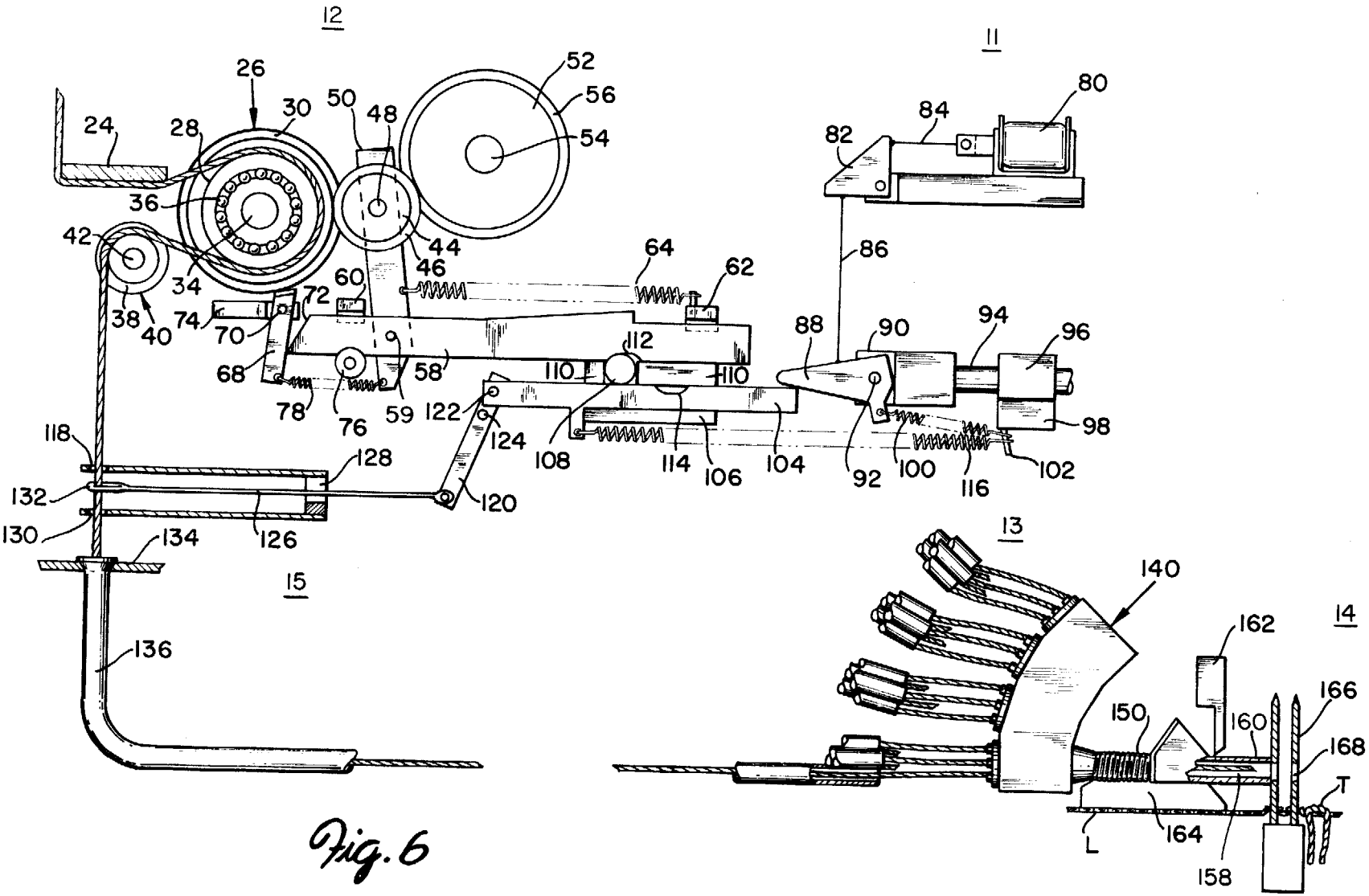

From the structure described thus far, it can be appreciated, as best shown in FIG. 6, that as the selector bar 58 slides to the left, two things will happen which affect the yarn feed wheel 26. First, as the inclined end 72 of the selector bar engages brake tab 68, this tab, which previously was in engagement with the yarn feed wheel 26, will become disengaged therewith. Secondly, the changing location of pivot pin 59 will cause the carrier 50 to shift, placing the engaging wheel 44 into engagement with the yarn feed wheel 26 and thus, in position to receive and transfer rotary motion from drive roll 52 to yarn feed roll 26.

As seen in FIG. 2, the selection actuation means 11 of FIG. 1 comprises a solenoid 80, connected to a bell crank lever 82 by means of solenoid pull wire 84. A selector key 88 is controlled by the motion of bell crank lever 82 as received through a second pull wire 86. The selector key 88 is pivotally attached to carrier bar 90 by means of pin 92. At the rear of selector key 88, a push rod 94 is supported by bearing block 96, which is, in turn, supported by mounting bar 98, extending widthwise across the machine. As shown in FIG. 1, the push rod 94 is driven by cam 19 mounted to shaft 18. Returning to FIG. 2, it is seen that selector key return spring 100 biases selector key 88 downwardly toward retainer rod 102 which extends below mounting bar 98.

As shown in FIG. 2, interlock bar 104 located below selector bar 58 is slidably supported in one of the grooves of bearing guide 106. A locking disc 108 between selector bar 58 and interlock bar 104 is bounded to the right and left by bearing guides 110. The selector bar 58 has a camming notch 112 on its underneath portion, while the interlock bar 104 has a camming notch 114 in its top surface; the purpose of each notch is to receive locking disc 108 at particular times in the operation as later will be described on pages 15 and 18. An arm 115 extends below interlock bar 104 for the purpose of receiving a return spring 116 which biases the bar 104 toward the mounting bar rod 102 where it is attached.

From yarn guide wheel 40, the yarn strand extends downwardly through pullback mechanism 15, which will now be described. The yarn from yarn guide wheel 40 passes through yarn guide 118, yarn pullback loop 132 and yarn guide 130. A pullback lever 120 is pivotally mounted by pin 122 to the forward end of the interlock bar 104. A pivot shaft 124 extends widthwise of the machine and passes through the pullback lever 120 to serve as a fulcrum. A pullback wire 126 extends from the lower end of the pullback lever 120 through the pullback guide structure 128 and between upper yarn guide 118 and a lower yarn guide 130 terminating in the yarn pullback loop 132.

In operation, it will be seen that when the solenoid 80 is energized and bell crank arm 82 is raised, the selector key 88 will engage selector bar 58 causing it to move to the left. This causes the release of brake tab 68 and the shifting of engaging wheel 44 as previously described. The selector key 88 also controls the operation of interlock bar 104 and the pullback function as will be described in detail with the aid of FIGS. 4 through 8, which illustrate sequential positions of the various mechanisms.

Figure 3:
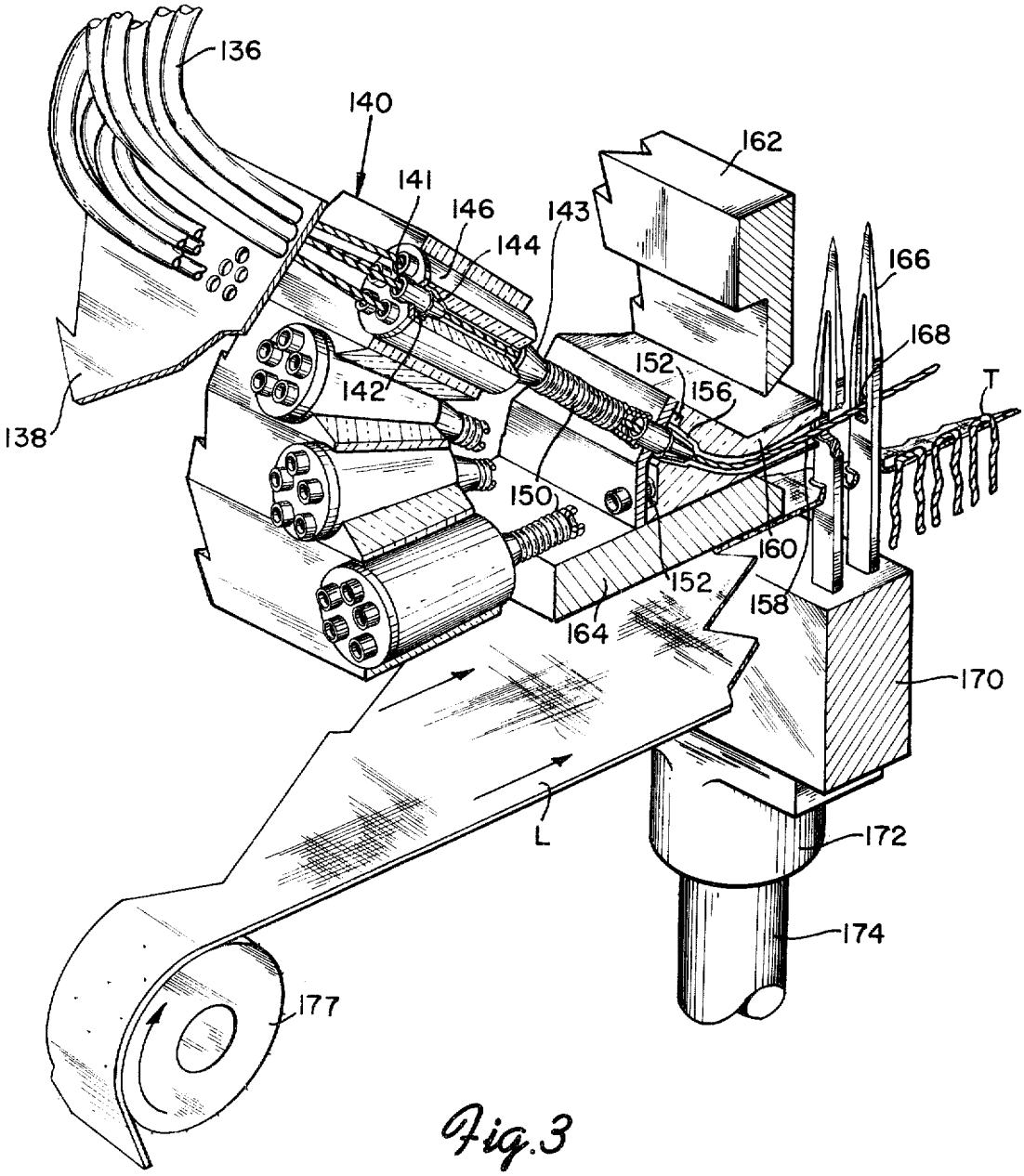
FIG. 3 discloses the pneumatic air transport system and the collector cone structure utilized in the axially reciprocable shuttle nose structure of the first embodiment.
Figure 4:
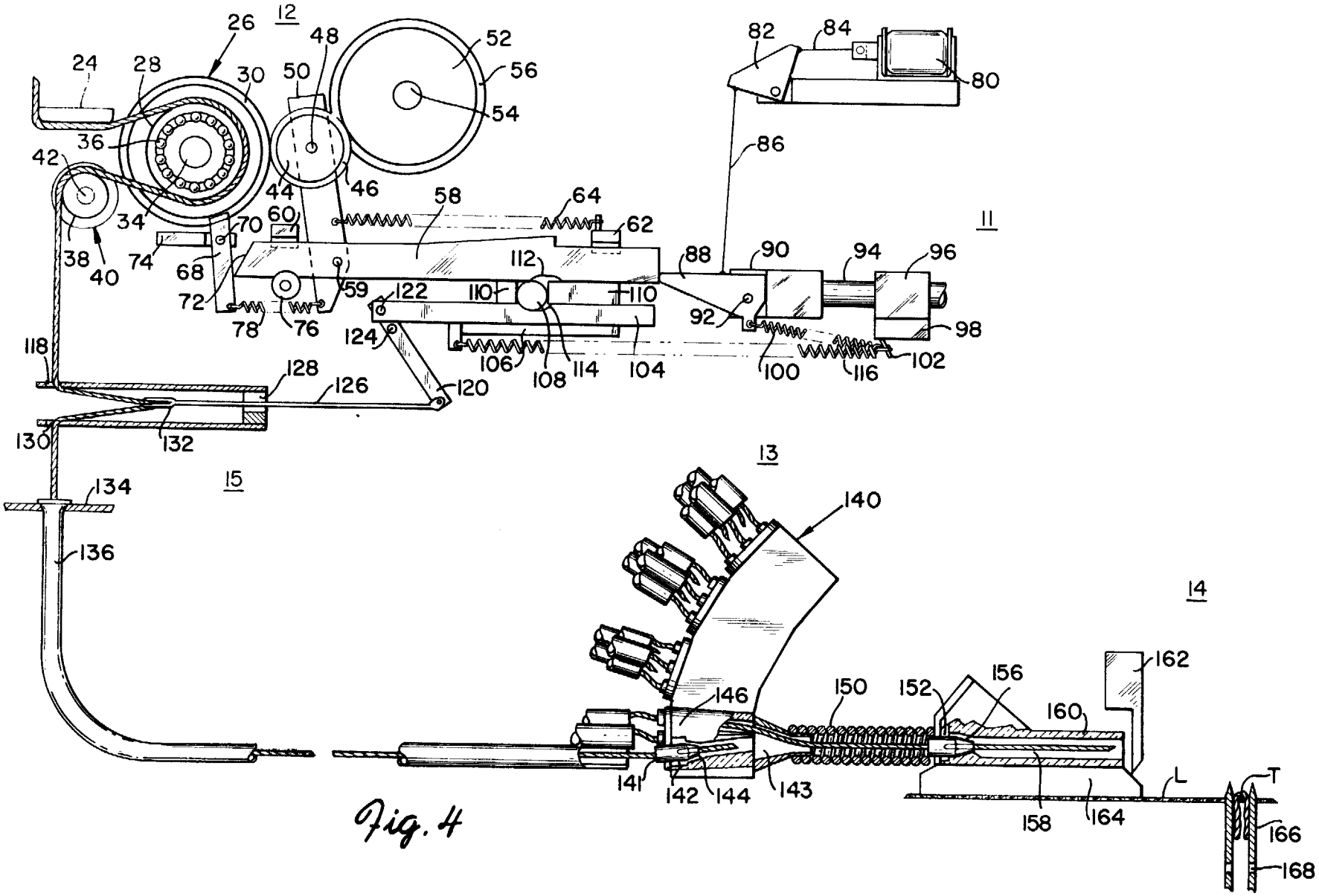
FIGS. 4–8 show five sequential views illustrating the operational steps of the tufting apparatus disclosed in FIGS. 1–3.

Each of the yarn strands A-E (FIG. 1) which is advanced by a separate one of the tiered metering and feeding apparatus 12 and a separate one of the pullback apparatus 15, as above described, extends downwardly to tube bank header 134 (FIG. 4). While only one yarn is shown entering the header 134 in FIG. 4, it is to be understood five yarn strands for each tufting position enter this header and are again in approximate parallel alignment. Below the tube bank header 134, tubing 136, (one tube for each yarn), extends into the lower plate 138 (FIG. 3) of the tube bank where they are realigned into a circular configuration. From this configuration, as shown in FIG. 3, the strands are fed into a carrier block 140 where they come under the influence of the primary pneumatic transport 146. As seen in FIGS. 3 and 4, the yarn strands each enter an individual entry cone 141 having a gas chamber 142 from which gas flows into common passage tube (collector cone) 143 by means of gas passages 144. The yarn strand extends from collector cone 143 into a yarn guide spring and exhaust gas dissipater 150, all of the foregoing being part of the primary pneumatic transport 146. Following the discharge end of the dissipater 150 is a secondary pneumatic transport having a gas chamber 152 from which gas flows through gas passageway 156 into passageway 158 which extends through shuttle nose 160. Both the primary and secondary pneumatic transport systems may be supplied gas by the compressor 152, shown schematically in FIG. 1, via valves operated by means of cam 153. These valves vary gas flow during the machine cycle in accordance with machine needs.

A severing member 162 operates from cam 163 (FIG. 1) and is aligned with anvil member 164 below the shuttle nose 160 which is axially reciprocable to expose the yarn for severing. As shown in FIG. 3, dual needles 166 with aligned eyes 168 receive the yarn strands as they exit from passageway 158. The needles 166 are mounted on needle bar 170 which is supported on push rod foot 172 of push rod 174, which, via cam 176 (see FIG. 1) provides reciprocable motion to the needle bar 170 and needles 166.

A pin roll 177 is shown in FIG. 3 as a guide means for backing layer L. Alternatively the backing may be fed from supply roll 178 over support member 180 (see FIG. 1). U-shaped tufts T (see FIG. 3) are shown implanted into the backing layer in the manner of my aforementioned U.S. Pat. No. 3,554,147 and U.S. Pat. No. 27,165. Idler roll 182 (FIG. 1) directs the tufted product to the take-up pin-roll 184 which operates from the ratch and pawl mechanism 186.

Figure 7:
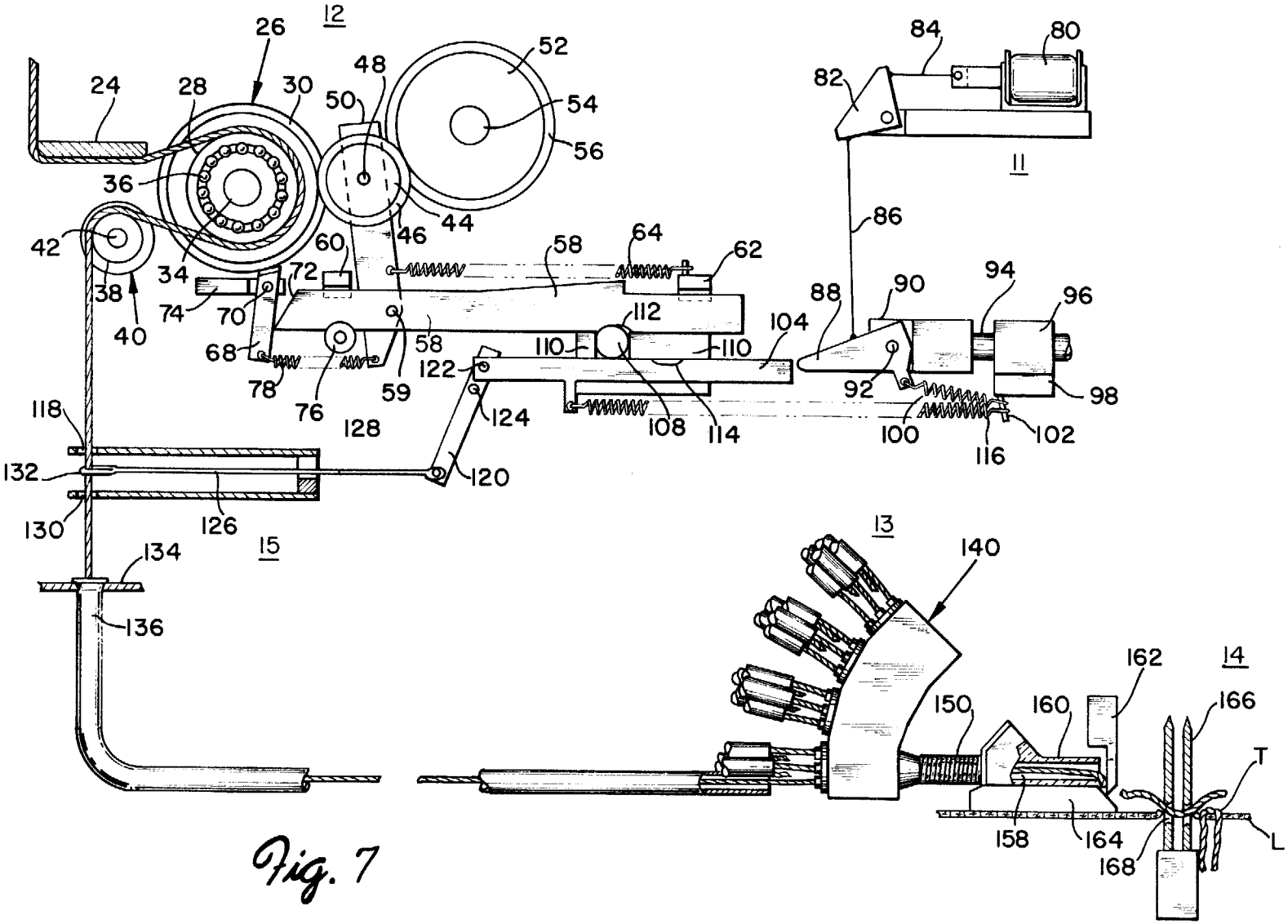
Figure 8:
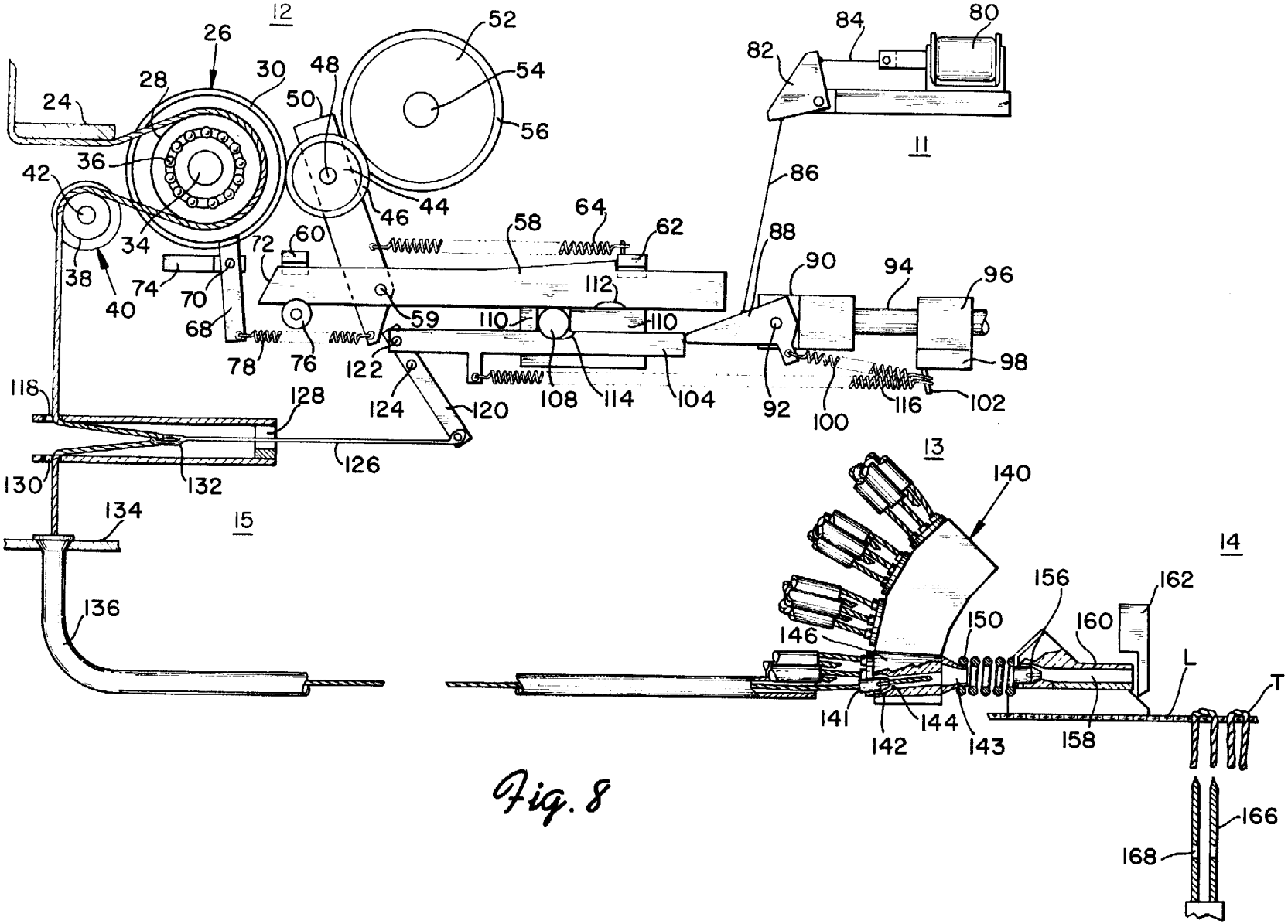

As shown in FIG. 7, when the yarn strand is advanced to a loading position, shuttle nose 160 shifts to the left and knife member 162 descends against anvil 164 severing the yarn into a predetermined discrete yarn bit. Then, as shown in FIG. 8, needles 166 descend to implant the yarn bit into the backing layer with its legs forming the U-tuft.

It will be appreciated that once the yarn strand is cut and the yarn bit tufted, that particular yarn strand may be withdrawn (see FIG. 8) by the pullback means 15 so that the common passageway 158 is clear, thus making possible the feeding of another strand of yarn, preparatory to the implantation of the next yarn bit.

Having described the overall operation and the mechanical elements of the tufting apparatus, a step-by-step sequential description follows, as depicted in FIGS. 4–8. With respect to FIG. 4, the signal calling for a particular color strand to be next tufted is transmitted to the particular selector actuator (solenoid 80) which is associated with the metering and feed apparatus 12 that controls that particular strand. The solenoid 80 transmits its motion through pull wires 84 and 86 and the intermediate bell crank lever 82 to selector key 88. The selector key 88 is lifted into the select, or on, position, thus overcoming the resistance of return spring 100, and then moves to the left toward selector bar 58. At this time, the drive roll 52 is stationary and there is no contact between the engaging wheel 44 and the yarn feed wheel 26. It is to be noted that spring 64 maintains contact at all times between engaging wheel 44 and drive roll 52. It is also to be noted that at this time the brake lever tab 68 is in contact with the yarn feed wheel 26 to prevent any motion of the feed wheel. Also, at this time, the yarn in the threader channel 158, which was utilized in the previous implantation, is being withdrawn to a standby position by the pullback mechanism 15 for that particular yarn (not shown on FIG. 4). This pullback is described subsequently. The yarn from the presently selected yarn metering and feed apparatus 12 shown in FIG. 4 is at this time in a standby position in its primary pneumatic transport channel.

The selector key 88, after engaging the selector bar 58, urges it to the left as the bias of return spring 64 is overcome. The inclined end 72 of selector bar 58 contacts the brake lever tab 68 and starts moving it out of contact with drive groove 30 of feed wheel 26. During this motion, contact between engaging wheel 46 and yarn wheel 26 is established. The tufting needles 166 continue their descent as they complete the implantation of the previous tuft.

Figure 5:
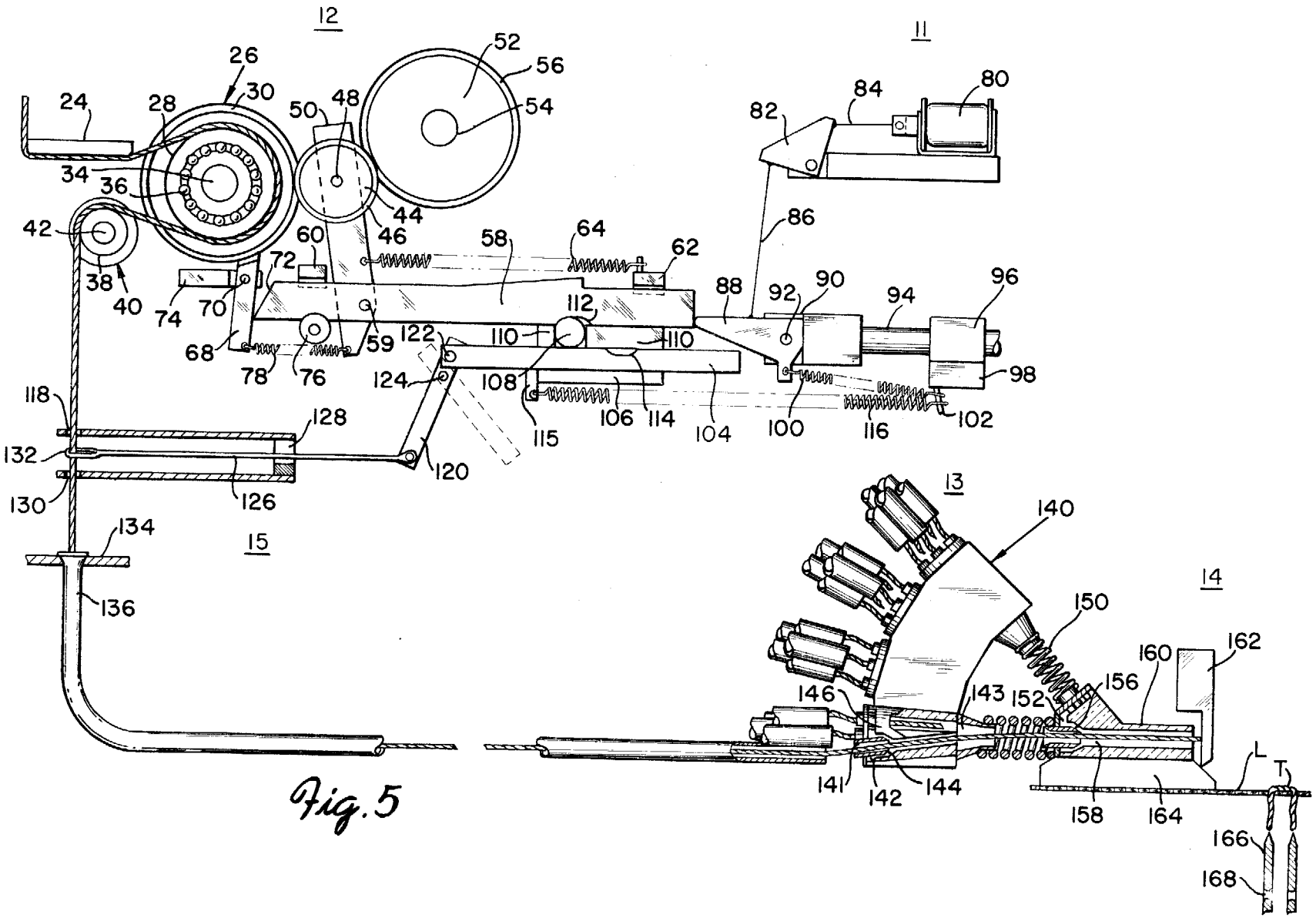

With reference to FIG. 5, the following changes then occur. Selector key 88 has reached the end of its travel to the left, pushing selector bar 58 to its extreme left position such that locking disc 108 becomes aligned with notch 112 in the underside of the bar 58. The bias on the interlock bar 104, imposed thereon by return spring 116 cams the locking disc 108 up into the selector bar notch 112 forcing the interlock bar 104 to move to the end of its travel to the right. As this occurs, pullback lever 120 swivels to its release position and pullback wire 126 advances to the left thereby releasing the yarn previously held by pullback loop 132. As this yarn is released, the gas flow in the primary pneumatic yarn transport thrusts the yarn strand into the common passageway 143, from whence it is transported by the secondary pneumatic yarn transport into the threading channel 158 of shuttle nose 160. Meanwhile, the end of the selector bar 58 has completely disengaged the brake tab 68 from feed wheel 26 and the engaging wheel 44 is forced into firm contact with drive groove 30 of yarn feed wheel 26.

At this time, the needles 166 have reached their full down position and backing layer L starts moving to receive the next tuft. It will be noted that the knife member 162 is still in the down position.

After the components reach the positions shown in FIG. 5, the selector key 88 and carrier bar 90 begin moving toward the right. There yet is no motion of either the feed wheel 26 or the drive roll 52.

With reference to FIG. 6, solenoid 80 is deenergized and spring 100 causes selector key 88 to drop and rest on interlock bar 104, needles 166 are raised through the backing L to their full up position, knife 162 is moved upward and shuttle nose 160 is moved to seat against left needle 166 with passageway 158 aligned with needle eyes 168.

Also the drive roll 52 starts rotation and this motion is imparted to the feed wheel 26 through engaging wheel 44. Thus, yarn is pulled from the creel, advanced and metered by feed wheel 26 and transported through tube 136 to passageway 158 by means of the primary and secondary pneumatic yarn transports.

As seen in FIG. 7, the yarn feed started in FIG. 6 is continued until drive roll 52 ceases rotation, at which time the yarn strand is fully extended through needle eyes 168. The needles 166 then begin their descent, pulling the yarn against the backing layer L. The shuttle nose 160 and the pneumatic transport system parts move to the left, clearing the downward path for the knife 162. The knife member 162 then descends, cutting the yarn into a discrete yarn bit by impacting against anvil member 164.

The selector key 88 during this time has moved downward and off the end of interlock bar 104 and is pulled by return spring 100 to its full down or "off" position. This occurs as selector key 88 and its carrier bar 90 reach the end of travel to the right.

As seen in the final sequential drawing, FIG. 8, the needles 166 continue their descent, implanting the yarn tuft in the backing layer L. The selector key 88 moves to the extreme left position, pushing interlock bar 104 to the left, thus moving pullback lever 120 to its full pullback position. This causes pullback wire 126 to move to the right, resulting in the withdrawal of yarn from the common yarn passageway 158, as shown in FIG. 4 by the yarn in tube 136, thus leaving the common passageway 158 free to receive a new yarn stand.

When the interlock bar 104 reaches the end of its leftward travel, its locking notch 114 is aligned with the locking disc 108, thus allowing the biasing to the right imparted to selector bar 58 by return spring 64 to cam the locking disc 108 down into the locking notch 114 of the interlock bar 104. This movement of the locking disc 108 frees the selector bar 58 to move to the right as urged by return spring 64. This rightward motion frees brake tab 68 to return to its position of engagement with feed wheel 26 as urged by tension spring 78 and also disengages wheel 44 and the feed wheel 26. One complete cycle is thus completed, with return of components to approximately the positions shown in FIG. 4.

In addition to the embodiment described in FIGS. 1–8, an alternative but related type of tufting apparatus may be utilized as shown in FIGS. 9-16. In these figures, a new set of item identification numbers are used, some of which are the same as those used in the previous embodiment.

Figure 9:
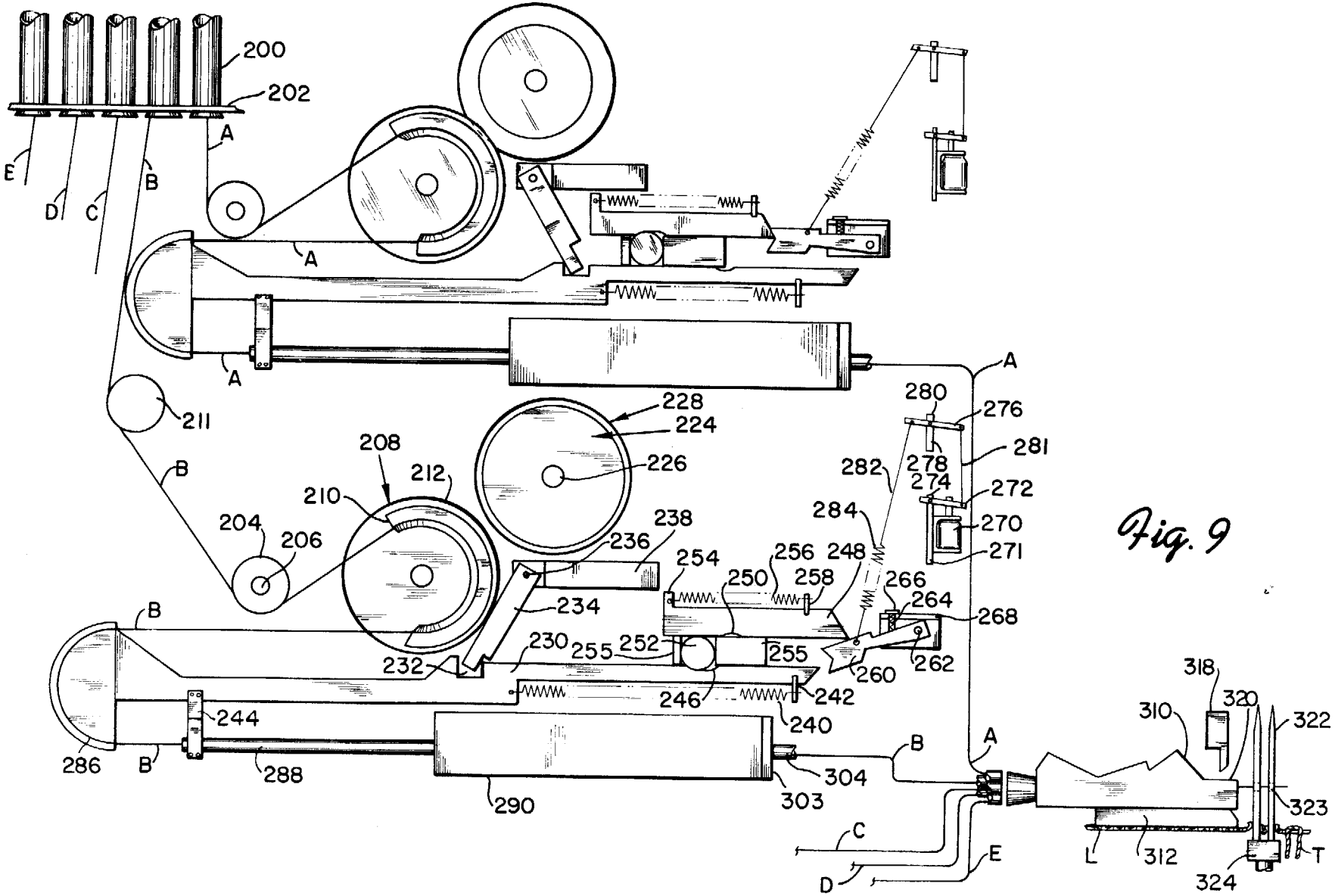
FIG. 9 is a schematic view showing a second embodiment of the pneumatic tufting apparatus, including two of a series of five yarn feeding and transporting mechanisms; the schematic of the invention, however not being limited to five such mechanisms (or colors) for each tuft implanting means.
Figure 10:
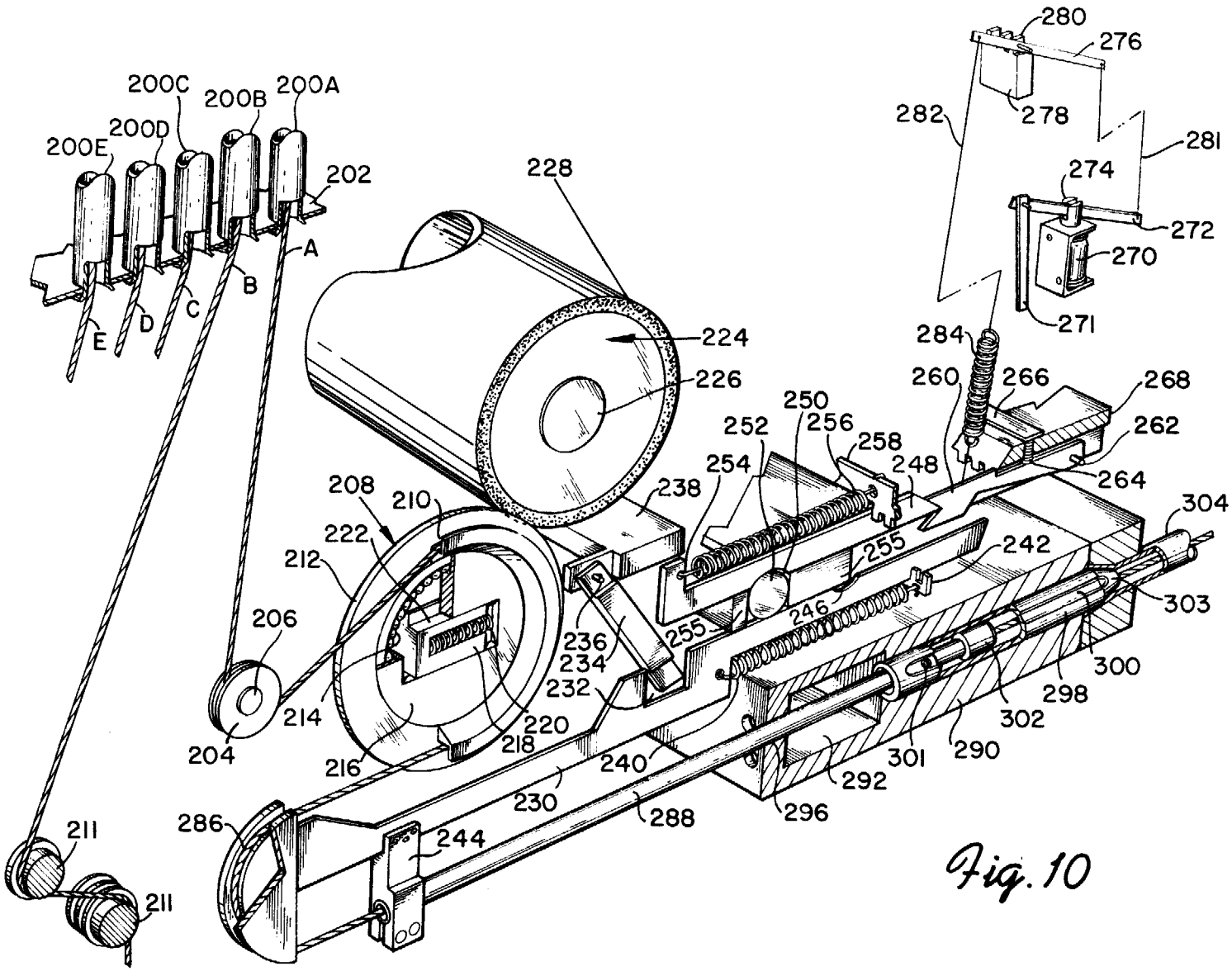
FIG. 10 is a perspective view of the yarn metering, feeding and pullback mechanisms of the second embodiment of the tufting apparatus of FIG. 9.

As seen in FIGS. 9 and 10, creel 200 (200A–200E in FIG. 10) guide the yarn from creels or other sources (not shown). A header plate 202 spaces and locates the yarn infeed. The yarn strands are once again identified as A, B, C, D, and E and here represent five yarns, each differing from the others in regard to color or some other characteristic. The number of tubes of yarns having different characterisitcs is arbitrary and obviously not limited to five. In this embodiment, as was true in the previous embodiment described in FIGS. 1 to 8, for each needle station, any one of five color strands may be selected for each tuft to be implanted into a backing layer L. The metering system operates similar to the one previously described, however, a number of important differences exist. For clarity, two yarn selection, metering, feeding and pullback units are shown in FIG. 9; with the upper unit being in the "selected" or active position, and the lower unit being in the standby position.

Referring to FIGS. 9 and 10, each yarn is guided by yarn guide turn bar 211 and is then guided to a respective yarn guide roller 204, rotatable on mounting shaft 206, to respective feed wheel 208. It will be seen in FIG. 10 that the yarn feed wheel 208 includes a drive surface 212, bearing balls 214, a bearing washer 216, which is designed to laterally slide on mounting bar 218, and is spring loaded by loading spring 220.

Drive roll 224 is mounted adjacent the feed wheel 208 on drive shaft 226 and has a friction coating 228 which is engageable with the drive surface 212 of the feed wheel 208.

A modified selector bar 230 is positioned below the yarn feed wheel 208 and the drive roll 224 and has a drive slot 232 which engages the base of brake lever 234. The brake lever 234 is pivotally mounted by means of pin 236 on a brake lever mounting bar 238.

The selector bar 230 has a return spring 240 one end of which is attached to the bearing guide 242 to effectively bias the selector bar 230 to the right. The selector bar 230 has rigidly mounted thereto, a tube drive bracket 244 for a purpose to be subsequently described, and a locking notch 246 on its top surface. The interlock bar 248 in this embodiment is positioned above the selector bar 230. It has a notch on its base surface 250 which is designed to engage locking disc 252. At the top of interlock bar 248 an upper arm 254 receives the return spring 256 which extends to the bearing guide 258.

To the left of the interlock bar a selector key 260 similar to that described in the previous embodiment is shown engaging the interlock bar 248 in the "select" or "on" position in the upper unit of FIG. 9 and in FIG. 10. The selector key 260 is pivotally mounted on pin 262 and has a return spring 264 which engages retainer plate 266. Adjacent the selector key 260 is the selector key carrier bar 268 operable in the same manner as the carrier bar of the previous embodiment.

As described in the previous embodiment, various types of devices may be used for the yarn selection actuator, and, as exemplified there, a solenoid 270 is shown here as the actuator. The solenoid 270 has a plunger 274 which is pivotally mounted to solenoid lever arm 272, one end of which is supported by strut 271. The solenoid rocker arm 276 is connected to a stationary rocker arm block 278 by pivot pin 280. A solenoid pull wire 281 extends from lever arm 272 to rocker arm 276 and a second pull wire 282, including a spring portion 284, extends from the rocker arm 280 to the selector key 260.

After the yarn strand leaves the yarn feed wheel 208, it is received by the spool-like yarn guide 286 and guided from there into the pneumatic transport tube 288. The yarn guide 286 is rigidly mounted to the selector bar 230 and serves as a pullback device which corresponds in function to that described in the previous embodiment.

As will subsequently be described in more detail, the selector key 260 controls the lateral reciprocation of selector bar 230 which causes brake 234 to engage and disengage feed wheel 208 and simultaneously causes the pullback guide 286 to move left and right; when moving left causing pullback of the yarn strand in contact with 286.

As will be seen in FIG. 10, the primary pneumatic transport includes a yarn transport block 290 with its gas passageway 292. The inlet tube 288 has a gas seal bearing surface 296 to allow for its reciprocation and it extends into a receiving tube gas jacket 298 having gas bypass grooves 300 along the outer surface. A gas valve orifice 301 is in each of the grooves 300 which is engaged and closed from within by a gas valve member 302 which is at the extremity of the inlet tube 288. At the far right hand side of the air transport block 290, an air feed nose 303 of the air jacket 298 leads into carrier yarn tube 304 which joins with similar tubes from the other four units at plate 306 (see FIG. 11). The tubes 304 only one of which is shown in FIG. 10 then lead into one of the collector cones 308 as seen in FIG. 11 which are part of the carrier block structure 310.

Figure 11:
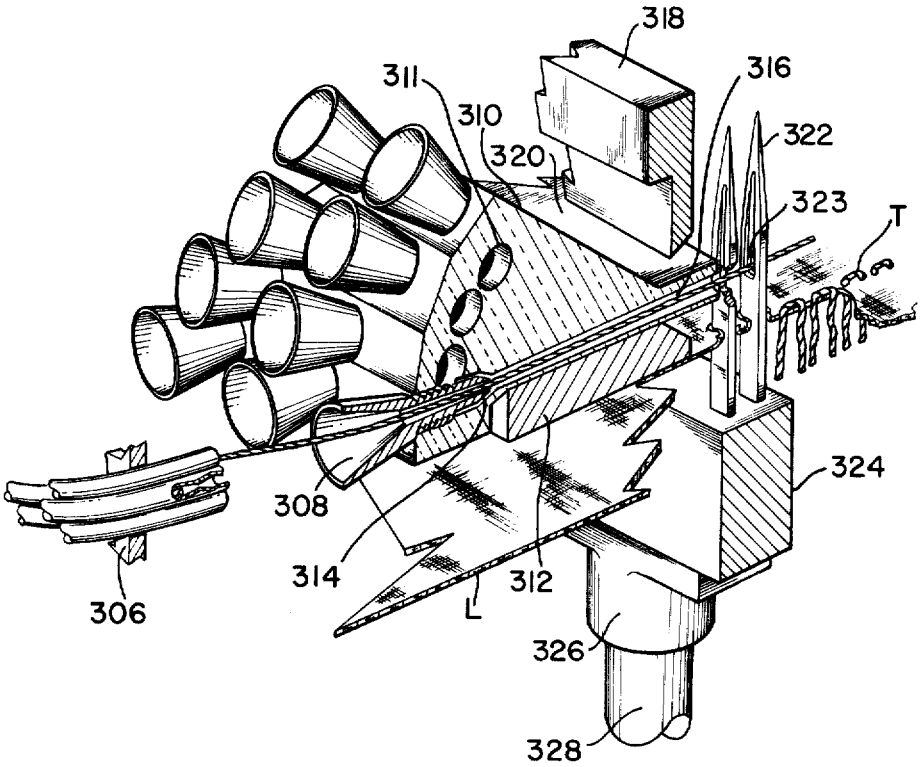
FIG. 11 is a perspective view of the shuttle nose structure in the tufting apparatus disclosed in FIG. 9.
Figure 12:
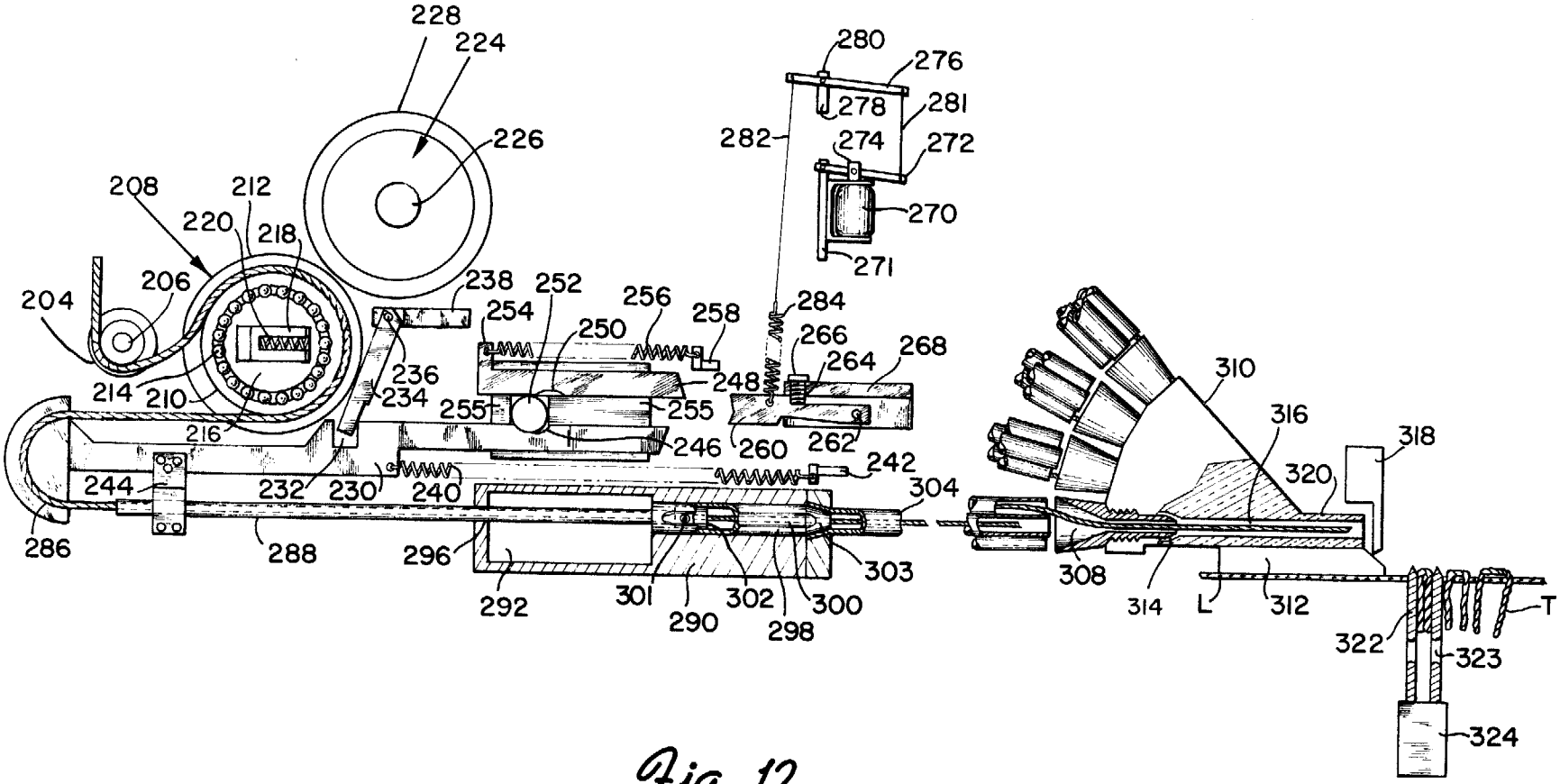
FIGS. 12–16 show five sequential views depicting the operation of the tufting apparatus of FIGS. 9–11.

As shown in FIGS. 11 and 12, the carrier block 310 contains the secondary pneumatic yarn transports, ending in common passageway 316. Secondary gas chambers 311 (FIG. 11) in carrier block 310 supply gas to the pneumatic transport nose 314 of the common passageway 316. Knife member 318 is positioned above the shuttle nose 320 of the block 310 and engages the anvil 312 to cut the yarn when the block 310 and its shuttle nose 320 shift to the left as described in the previous embodiment. Needles 322 with their eyes 323 are connected to the needle carrier 324 operable on push rod foot 326 (FIG. 11) and the push rod needle drive 328 (FIG. 11) as in the previous embodiment.

While the secondary pneumatic yarn transport (contained in block 310, FIG. 12) in this latter embodiment may be controlled by valves operated by cam 153, as shown in FIG. 1, the primary pneumatic yarn transport (contained in block 290 and tube 288, FIG. 12) is valvable by means of the reciprocating inlet tube 288 which reciprocates with selector bar 230, to which it is rigidly secured, and thus is controlled by cam 19 of FIG. 1 whenever that particular unit is actuated by energization of solenoid 270, FIG. 12, which corresponds to solenoid 80, FIG. 1.

FIGS. 12 to 16, show the sequential operation of the second embodiment of the overall tufting system. As shown in FIG. 12, the first of the sequential drawings, the solenoid 270 is energized to activate the particular yarn strand controlled by the selector feed unit shown. The motion of solenoid plunger 274 is transmitted to selector key 260 via the intermediate mechanism 272-282 causing the selector key 260 to be raised, overcoming the downward bias of spring member 264.

At the start of the solenoid energization, the drive roll 224 has no motion, and is not in contact with yarn feed wheel 208. The brake lever 234 is in contact with the yarn feed wheel 208 to prevent any motion of the wheel. The primary air transport system is in its gas off position, with the gas valve surface 302 of the inlet tube 288 covering the gas orifice 301 in the air jacket 298.

The yarn from the particular yarn metering and feeding unit shown is in its feed tube 304 in the standby position, while another strand of yarn, that earlier was supplied by another yarn metering and feed unit, is in the threader common channel 316, and is being retracted to a standby position.

At this time, the carrier bar 268 is cyclically driven to the left, as described in the previous embodiment, by cam 19, FIG. 1, thus moving carrier selector key 260 leftward to engage the interlock bar 248.

Figure 13:
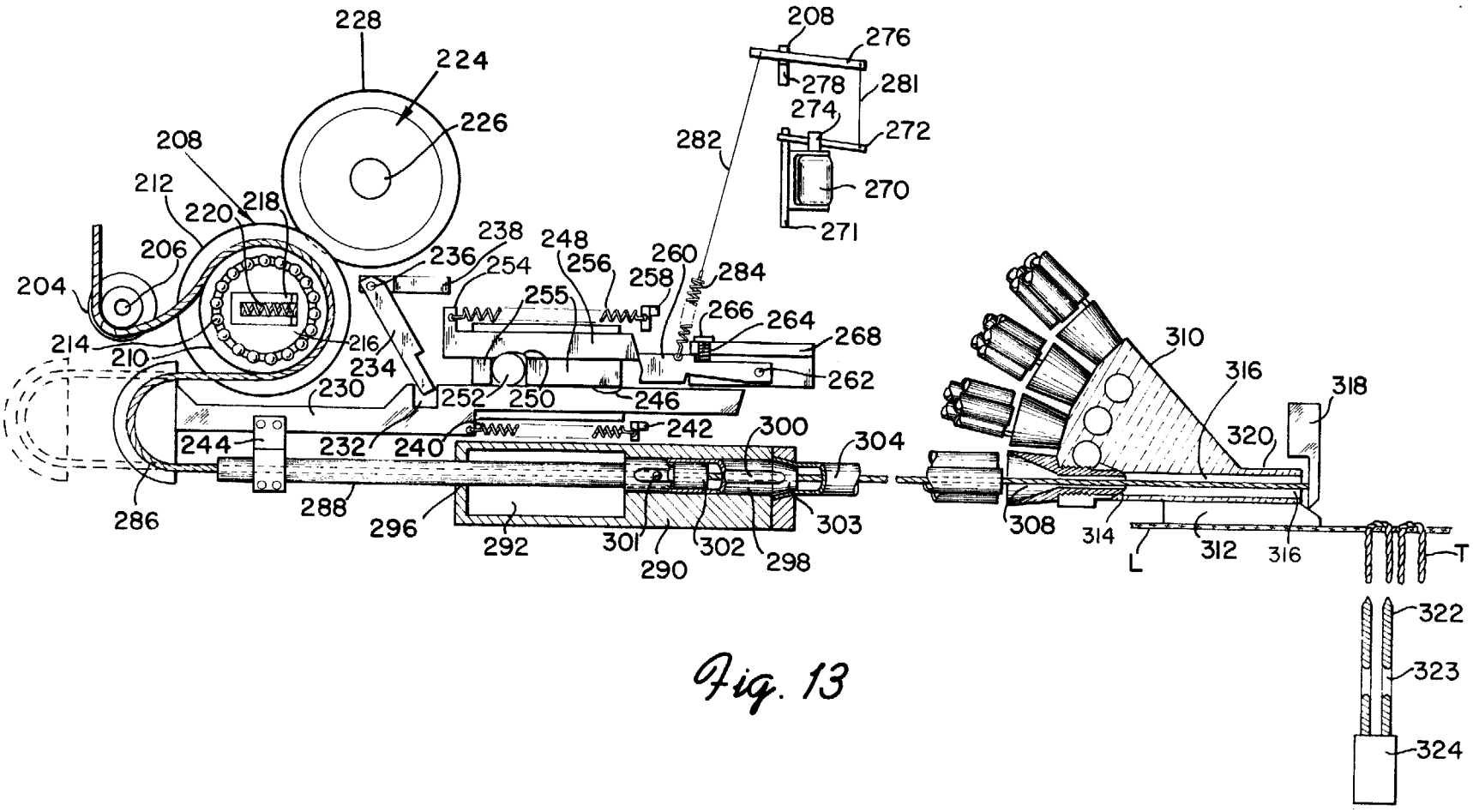

As shown in the second sequential drawing, FIG. 13, the continued leftward motion of selector key 260, after establishing contact with the interlock bar 248, pushes 248 to the position where the notch 250 in the bottom of bar 248 aligns with the locking disc 252.

Locking disc 252 is prevented from any axial motion by interlock disc bearing guide 255.

The interlock disc 252 cams up into the locking notch 250 thus allowing the selector bar 230 to move to the right, as urged by return spring 240.

This movement to the right of selector bar 230 causes the brake lever 234, which is engaged in the drive slot 232, to shift to the right, together with pneumatic transport tube 288.

As the pneumatic transport tube 288 moves to the right, valve surface 302 moves from its gas-flow-off position in the tube jacket 298 to its gas-flow-on position to the right of gas orifice 301. Gas is now free to flow from the compressed gas chamber 292 into gas jacket 298, through each gas orifice 301 and along the outside of gas jacket 298 by means of gas bypass grooves 300 and over the nose 303 into tube 304, where the gas flow exerts a rightward thrust on the yarn strand within tube 304.

Concurrently, as the selector bar 230 moves to the right, it carries with it the yarn guide pullback 286. This left to right movement of 286 releases the yarn from its original pullback position of FIG. 12, as shown by dotted lines in FIG. 13.

The gas flowing through 288 and 304 of the primary pneumatic yarn transport thrusts rightwardly the yarn which has been released by the rightward motion of 286 and thus advances the end of the selected yarn in tube 304 from its standby position (see FIG. 12) into the collector cone 308 which, in turn, via the secondary pneumatic yarn transport operating from gas flow through nose 314, thrusts the yarn to its full length in the common threader passageway 316.

As the brake lever 234 moves to the right, it permits yarn feed wheel 208 to move to the right with it until drive surface 212 is brought into contact with friction surface 228 of the drive roll 224, at which point brake 234 disengages from 208.

It should be noted that the mechanical sequence just described of brake lever 234, feed wheel 208 and drive roll 224 ensures that the feed wheel is continuously under positive control, i.e., that the drive surface 212 is always either in contact with the brake lever 234 or the friction surface 228 of the drive roll 224.

At this time, the needles 322 are starting to move upwardly from their full down position and the backing L is starting to move incrementally to the right.

The knife 318 now moves upwardly and the carrier block 310 moves rightwardly toward its threading position.

Figure 14:
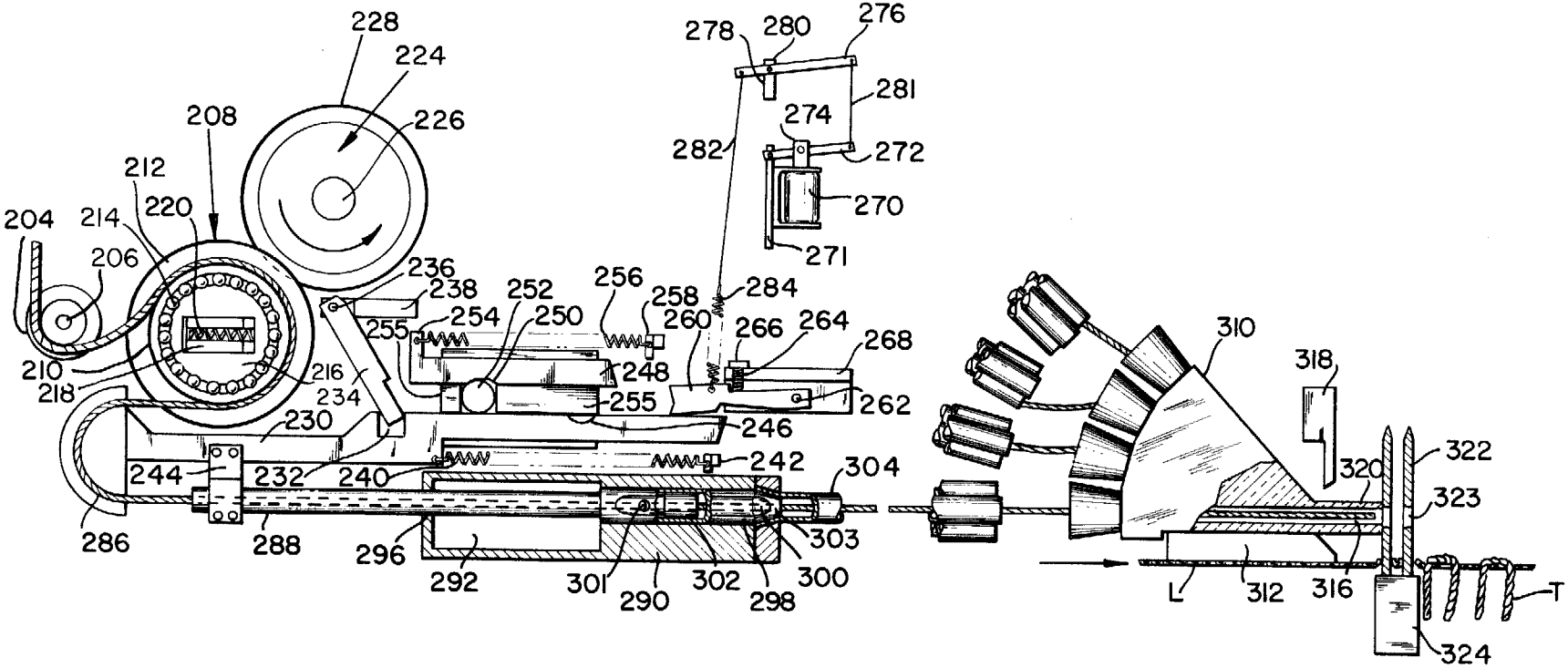

As shown in the next sequential drawing, FIG. 14, the incremental motion of the backing has ceased and the needles 322 have penetrated upwardly through the backing layer L and are in their full upward position. The carrier block 310 has reached its threading position, with the threader nose 320 against the left needle and aligned with the needle eye 323.

The selector key carrier 268 has now moved back to the right and the solenoid 270 has been de-energized, allowing return spring 264 to push selector key 260 down against selector bar 230.

Metered angular rotation of drive roll 224 rotation now starts, thus turning feed wheel 208, which, via friction contact with yarn in groove 210 draws yarn from the creel and delivers a metered length of the yarn around pullback guide 286 through pneumatic transport tube 288, yarn tube 304, carrier block 310, and finally through eyes 323 of needles 322.

Figure 15:
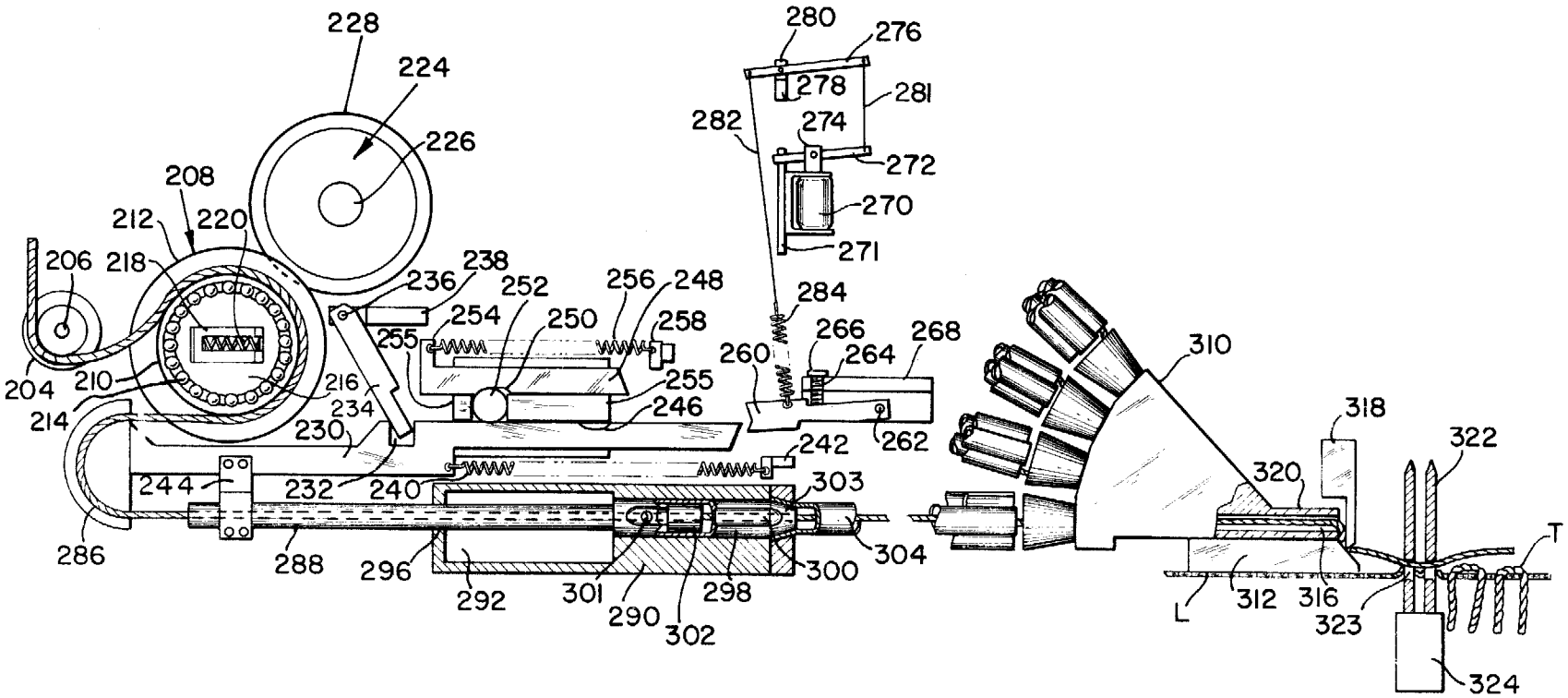

In the next sequential drawing, FIG. 15, the selector key carrier 268 has reached the end of its travel to the right, allowing selector key 260 to disengage contact with selector bar 230. The carrier block 310 has moved to the left, clearing the way for knife 318 to move down to sever the yarn by contacting anvil 312. Just prior to yarn severing, the needles 322 have started their descent pulling the yarn bit against the backing.

The needles 322 then continue their descent, the selector key carrier bar 268 moves to the left, and the selector key 260 engages selector bar 230 and moves it to the left, thus causing the yarn guide 286 to withdraw the yarn from threader channel 316.

With the leftward motion of selector bar 230, the primary air transport tube 288 is drawn to the left and brake lever 234 is also driven to the left by drive slot 232.

Figure 16:
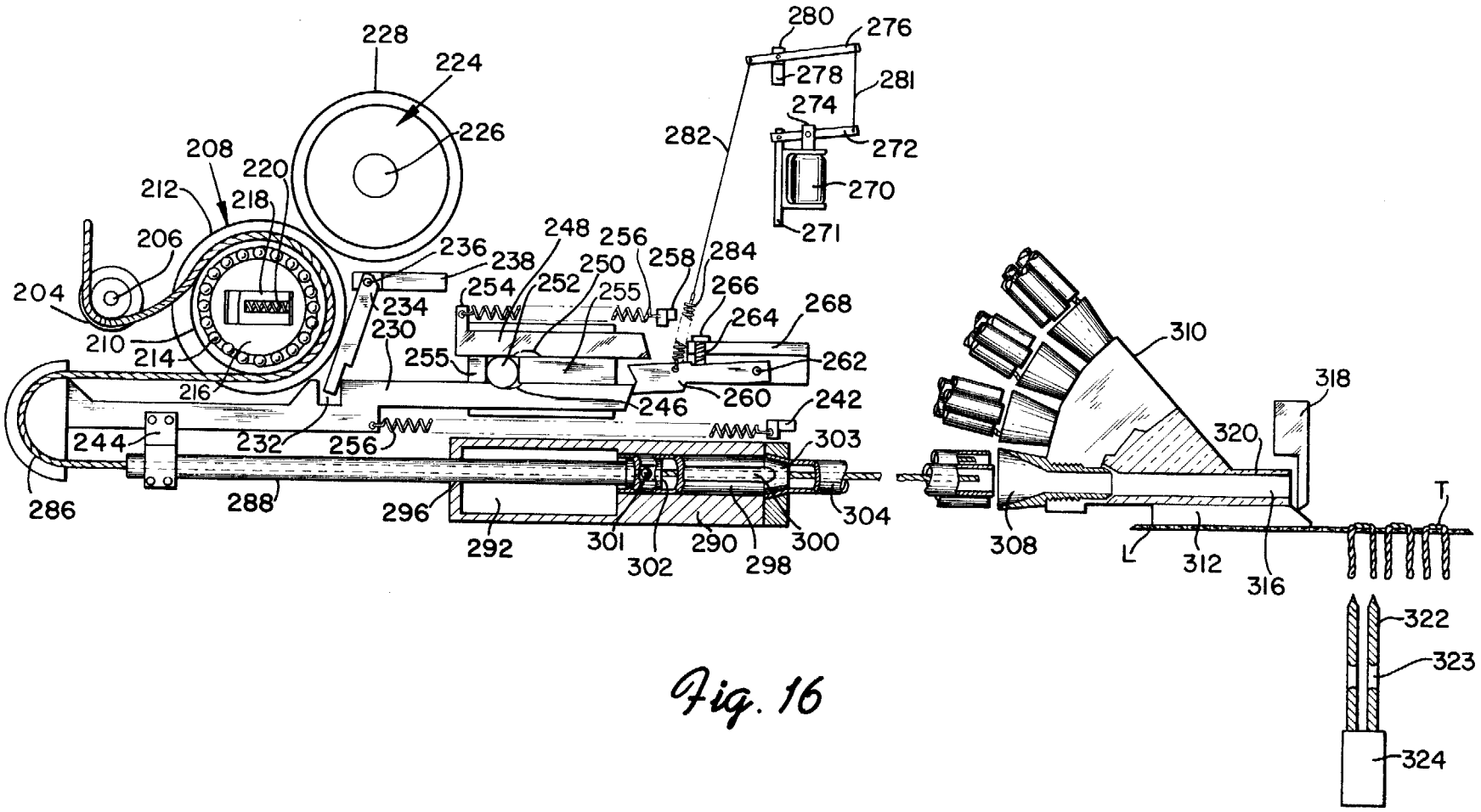

In the last sequential drawing, FIG. 16, the selector key carrier bar 268 has reached the end of its leftward travel together with selector bar 230. The yarn is fully pulled back by pullback guide 286 to its standby position. The selector bar notch 246 is aligned with the locking disc 252 and the rightward thrust to interlock bar 248 by return spring 256, cams the locking disc 252 down into the selector bar locking notch 246, thus freeing the interlock bar 248 to move to the right as urged by spring 256.

The brake lever 234 has been moved to its extreme left position by drive slot 232 of the selector bar 230. During this leftward movement, brake lever 234 first engaged the drive surface 212 of feed wheel 208, following which wheel 208 was pushed to the left thus disengaging drive surface 212 from friction surface 228 of the drive roll 224.

The primary air transport tube 288 is moved fully to the left and the gas valve surface 302 covers the gas orifice 301, thus turning off the gas flow. At this time, the yarn tuft is implanted and the needles are in the full down position. Thus the sequence is complete, with return of the overall tufting mechanisms to essentially the positions described in FIG. 12, ready to repeat the next cycle.

The pullback device disclosed in the embodiment of FIGS. 9 to 16 results in less yarn deformation during pullback and release, thus offering substantial improvements over earlier pullback mechanisms.

In each of the embodiments, the primary and secondary pneumatic yarn transports provide materially improved performance over the single pneumatic yarn transport means used previously.

With respect to the selector key structure, it is important to note that the key 260 serves as a true trigger, in that it only couples or decouples energy supplied by the machine drive motor to operate the yarn metering and feeding mechanisms and is not required, itself, to supply this energy. This minimizes the size and complexity of the selector actuator, and the associated power consumed by the actuation.

It will be noted that the anvil 312, by virtue of its configuration and positioning, effectively also serves as a presser foot against the backing layer which facilitates easier withdrawal of the needles and less chance of backing deformation.

With respect to the embodiment disclosed in FIGS. 9 to 16 it is to be noted that the surfaces used for braking and driving of the feed wheel have no relative motion (slippage) at any time of the engage-operate-disengage cycle; this resulting in greatly increased operational life and efficiency of the metering system as well as providing greater accuracy in yarn metering than heretofore possible.

The valvable pneumatic yarn transport, comprising air block 290 and related structures provides decided advantages over previous systems in that actuating air or other gas is only admitted to that particular pneumatic transport tube in which yarn is being transported as contrasted to earlier systems in which air or another gas, under positive and/or negative pressure, was admitted to all pneumatic transport tubes, including those in which yarn was not being transported.

While various embodiments of the invention have been shown and described, it will be understood that other modifications may be made. The appended claims, therefore, are intended to define the true scope of the invention.

What is claimed is:

1. Tufting apparatus including bit-applying means for applying tufts to a backing layer wherein the improvement comprises:

metering means utilizing rotatable yarn feed means to provide predetermined lengths of yarn;

driving means engageable with a surface of said rotatable yarn feed means;

braking means engageable with a surface of said rotatable yarn feed means wherein said rotatable yarn feed means is always in engagement with either said driving means or said braking means; and pneumatic means to transport the yarn to a tufting station.

2. The tufting apparatus of claim 1 wherein said means for driving said rotatable yarn feed means comprises a drive roll means and means for said drive roll means to engage said rotatable yarn feed means to drive said rotatable yarn feed means.

3. The tufting apparatus of claim 2 wherein said rotatable yarn feed means is spring loaded and upon release of said braking means engages said drive roll means.

4. The tufting apparatus of claim 2 wherein said drive roll means includes a friction surface and said rotatable yarn feed means includes a drive surface which is engaged by said drive roll friction surface.

5. Tufting apparatus including bit-applying means for applying tufts to a backing layer wherein the improvement comprises a yarn supply system having:

metering means utilizing a rotatable yarn feed means;

means for controlling said rotatable yarn feed means including driving means and braking means, to feed a predetermined length of yarn wherein rotary motion of said driving means is transferred to said rotatable yarn feed means by means of a shiftable intermediate engaging wheel upon engagement of said intermediate engaging wheel jointly with said driving means and said rotatable yarn means; and pneumatic yarn transport means to transport the yarn to a tufting station.

6. The tufting apparatus of claim 5 wherein said shiftable intermediate engaging wheel is in continuous engagement with said driving means.

7. The tufting apparatus of claim 5 wherein said shiftable intermediate engaging wheel is rotatable about an axis and there is further included a carrier bar secured to said axis and a slidable member to which said carrier bar is pivotally mounted whereby upon the sliding of said slidable member, said carrier bar shifts said intermediate engaging wheel into and out of joint engagement with said rotatable yarn feed means and said driving means.

8. The tufting apparatus of claim 7 wherein said slidable member actuates and deactuates said braking means.

9. The tufting apparatus of claim 7 wherein said slidable member actuates said pneumatic means.

10. The tufting apparatus of claim 1 wherein said pneumatic means is opened in fixed time relation relative to the release of said braking means.

11. Tufting apparatus including bit-applying means for applying tufts to a backing layer wherein the improvement comprises a yarn supply system having:

metering means utilizing a rotatable yarn feed means;

means for controlling said rotatable yarn feed means including driving means and braking means, to feed a predetermined length of yarn;

pneumatic yarn transport means, including pneumatic valvable means, to transport the yarn to a tufting station wherein said valvable means comprises:

an axially reciprocable yarn transport tube having a gas cut-off surface forming a first part of a gas valve; and a structure containing one or more gas passageways and a gas orifice which forms a second part of a gas valve, which operates cooperatively with said first part of the gas valve to control gas flow through said gas passageways, said gas flow serving to transport yarn strand through said passageways, said gas flow being stopped when said transport tube slides to a position whereby said gas orifice is covered by said gas cut-off surface.

12. Tufting apparatus including bit-applying means for applying tufts to a backing layer wherein the improvement comprises a yarn supply system having:

metering means utilizing a rotatable yarn feed means;

means for controlling said rotatable yarn feed means including driving means and braking means to feed a predetermined length of yarn;

pneumatic yarn transport means, including pneumatic valvable means, to transport the yarn to a tufting station wherein said valvable means comprises:

structure having a gas passageway through which gas flows when serving as a pneumatic yarn transport; and a reciprocable member complementary to said structure and operating in conjunction therewith to alternately prevent and permit said gas flow through said gas passageway as said member reciprocates.

13. Tufting apparatus including bit-applying means for applying tufts to a backing layer wherein the improvement comprises a yarn supply system having:

metering means utilizing a rotatable yarn feed means;

means for controlling said rotatable yarn feed means including driving means and braking means, to feed a predetermined length of yarn; and pneumatic yarn transport means, including pneumatic valvable means, to transport the yarn to a tufting station wherein said pneumatic yarn transportation means comprises yarn transportation passageways and said valvable means comprises a gas inlet communicating between a gas supply and said passageways and a reciprocable member which by means of the reciprocation starts and stops gas flow to said passageways.

14. The tufting apparatus of claim 13 wherein said braking means and said reciprocable member are actuated concurrently by means of a slidable bar member.

15. The tufting apparatus of claim 13 wherein said slidable bar member is controlled by a solenoid.

16. In a tufting machine:

reciprocable bit-applying means movable through a backing to and from a loading position on a selected side of the backing;

metering means, utilizing a rotatable feed, for advancing a predetermined length of tufting material;

severing means, adjacent said bit-applying means, for severing a bit-length of tufting material from said advanced predetermined length of tufting material;

pneumatic means for transporting said predetermined length of tufting material to said loading position;

means for actuating said severing means to sever said tufting material; and means for moving a portion of said pneumatic means to provide access for said severing means.

17. In a tufting machine:

reciprocable tufting-needle means movable through a backing to and from a threading position on a desired side of the backing;

strand-severing means adjacent said tufting-needle means for cutting yarn bits from a strand of tufting material;

a rotatable yarn feed and metering mechanism for advancing a predetermined length of yarn;

pneumatic transport means for transporting said strand to said threading position;

control means, including a shiftable member, which upon energization actuates said yarn feed and metering mechanism and said pneumatic transport; and means for actuating said strand-severing means.

18. Tufting apparatus including bit-applying means for applying tufts to a backing layer wherein the improvement comprises a means for delivering metered lengths of yarn from selected yarn sources to a tufting station, having:

a plurality of inlet passageways extending to a common outlet;

a plurality of metering devices, each metering yarn from a different yarn source and communicating with one of said inlet passageways;

means for pneumatically transporting a selected yarn through said common outlet and to the tufting station;

strand-severing means to sever said selected yarn preparatory to tufting the severed yarn bit;

pullback means to remove yarns from said common outlet; and control means, including a selector member, which activates one of said metering devices, said pneumatic transport means, and said pullback means.

19. A tufting machine utilizing multiple yarn sources to supply each tufting station comprising:

a plurality of inlet passages extending from said yarn sources to a common outlet;

a selector means disposed along each of said inlet passages including yarn metering and feeding means;

pneumatic transport means to transport through said common outlet a selected yarn metered and fed by said selector means;

bit-applying means positioned adjacent said common outlet to receive said selected yarn and apply a bit therefrom to a backing layer;

strand-severing means positioned adjacent said bit-applying means to sever said bit from said selected yarn;

strand pullback means to remove and hold all but selected strands of yarn from said common outlet passage; and control means, including actuation of a mechanical member, movement of which actuates a particular one of said selector means, releases said pullback means to allow said yarn to return to said common outlet passage, and actuates said pneumatic transport means to transport said yarn to said tufting station.

20. Tufting apparatus including bit-applying means for applying tufts to a backing layer wherein the improvement comprises a yarn metering and feeding system having:

a yarn feed wheel including means to bias axis of said yarn feed wheel in a given direction;

a brake member engageable with said yarn feed wheel;

a drive roll positioned adjacent said yarn feed wheel and in engagement therewith when said yarn feed wheel is in a biased position; and means to operate said brake member whereby when said brake member engages said yarn feed wheel said bias is overcome and said yarn feed wheel is disengaged from said drive roll; and when said brake member is disengaged from said yarn feed wheel said bias causes said yarn feed wheel to engage said drive roll, whereupon actuation of said drive roll said yarn feed wheel is actuated to meter a selected length of yarn.

21. Tufting apparatus including bit-applying means for applying tufts to a backing layer wherein the improvement comprises a yarn metering and feeding system having:

a yarn feed wheel;

a drive roll positioned adjacent said yarn feed wheel;

an intermediate engaging wheel mounted adjacent said yarn feed wheel and said drive roll on a carrier; and means to actuate said carrier to cause said intermediate engaging wheel to go from a position of disengagement with either said yarn feed wheel or said drive roll to a position of engagement with both said yarn feed wheel and said drive roll whereupon rotary motion of said drive roll is transmitted to said yarn feed wheel, said transmitted rotary motion permitting said yarn feed wheel to meter a length of yarn.

22. Tufting apparatus including bit-applying means for applying tufts to a backing layer and further including an arrangement for delivering metered yarn bits from selected yarn sources in desired sequence to each of a plurality of tufting stations, said arrangement for each tufting station comprising:

a plurality of inlet passages extending to a common outlet passageway;

a group of selectors, each having a passage for receiving yarn from a particular yarn source and communicating with a particular inlet passage;

yarn severing means actuable periodically to sever a yarn strand into a yarn bit;

a yarn pullback device to withdraw all but a selected yarn strand from said common outlet passageway;

a braking mechaniism for each of said selectors; and control means which concurrently releases said yarn pullback device and said braking mechanism on a desired one of said selectors, thereby causing a metered length of yarn to be fed into said common passageway.

23. The tufting apparatus of claim 22 further including:

pneumatic means to aid in transporting said yarn strand into said common passageway wherein said pneumatic means is energized by said control means in fixed time relationship with the pullback and brake release functions.

24. A tufting machine comprising:

a yarn source;

a yarn metering and feeding means including brake means;

a yarn pullback means which enables yarn previously fed to be returned to a standby position;

a pneumatic yarn transport means;

control means for actuating in substantially fixed time relationship said yarn metering and feeding means, said yarn pullback means, said pneumatic transport means, yarn severing means; and tufting elements to tuft said severed yarn.

25. Tufting apparatus including bit-applying means for applying tufts to a backing layer wherein the improvement comprises:

metering means utilizing rotatable yarn feed means to provide predetermined lengths of yarn;

driving means engageable with a surface of said rotatable yarn feed means;

braking means engageable with a surface of said rotatable yarn feed means;

braking means engageable with a surface of said rotatable yarn feed means and further including braking control means, the deactuation of which associatedly actuates said driving means; and pneumatic means to transport the yarn to a tufting station.

* * * * *